US009082364B2

(12) United States Patent
Lin et al.

(10) Patent No.: US 9,082,364 B2
(45) Date of Patent: Jul. 14, 2015

(54) INTEGRATED SOURCE DRIVING SYSTEM

(71) Applicant: AU Optronics Corp., Hsin-Chu (TW)

(72) Inventors: Yung-Hsu Lin, Hsin-Chu (TW); Ming-Hung Tu, Hsin-Chu (TW); Chun-Fan Chung, Hsin-Chu (TW); Chih-Che Hsu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 142 days.

(21) Appl. No.: 13/654,385

(22) Filed: Oct. 17, 2012

(65) Prior Publication Data

US 2013/0093742 A1 Apr. 18, 2013

(30) Foreign Application Priority Data

Oct. 18, 2011 (TW) ..... 100137690 A

(51) Int. Cl.
*G09G 3/36* (2006.01)
*G09G 3/34* (2006.01)

(52) U.S. Cl.
CPC ..... *G09G 3/3688* (2013.01); *G09G 3/3406* (2013.01); *G09G 2370/08* (2013.01)

(58) Field of Classification Search
CPC . G09G 3/3688; G09G 3/3696; G09G 3/3406; G09G 3/3648; G09G 2310/027; G09G 2310/0281; G09G 2310/0264; G09G 2310/0278; G09G 2300/0408; G09G 2370/08; G09G 2330/00; G09G 2330/02; G09G 2330/021; G09G 2320/06; G09G 2320/066; G09G 2320/0686; G09G 2320/0613; G09G 2320/062; G09G 2320/0626
See application file for complete search history.

(56) References Cited

U.S. PATENT DOCUMENTS

| | | | | |
|---|---|---|---|---|
| 5,757,634 | A | 5/1998 | Ferens | |
| 6,262,901 | B1 | 7/2001 | Simopoulos | |
| 6,346,798 | B1 | 2/2002 | Passoni | |
| 6,995,758 | B2 * | 2/2006 | Fukuda | 345/205 |
| 7,057,359 | B2 | 6/2006 | Hung | |
| 7,133,038 | B2 * | 11/2006 | Park et al. | 345/211 |
| 7,427,985 | B2 | 9/2008 | chen | |
| 8,643,638 | B2 * | 2/2014 | Bae et al. | 345/213 |
| 2005/0168429 | A1 * | 8/2005 | Chou | 345/100 |

(Continued)

FOREIGN PATENT DOCUMENTS

| | | | |
|---|---|---|---|
| CN | 1924964 | A | 3/2007 |
| CN | 101727850 | A | 6/2010 |

(Continued)

*Primary Examiner* — Jonathan Boyd
*Assistant Examiner* — Sardis Azongha
(74) *Attorney, Agent, or Firm* — Winston Hsu; Scott Margo

(57) ABSTRACT

A source driving system includes first and second source driving integrated circuits. The first driving integrated circuit includes a first source driver for receiving first display data and driving pixels in a first block of a display panel according to the first display data. The second source driving integrated circuit includes a second source driver electrically connected to the first source driver for receiving second display data and driving pixels in a second block of the display panel according to the second display data. The first and the second source drivers generate first and second display parameters according to the first and the second display data respectively. The second display parameter is transmitted from the second source driver to the first source driver. The first source driver generates a third display parameter according to the first and second parameters and transmits the third display parameter to the second source driver.

13 Claims, 6 Drawing Sheets

(56) References Cited

U.S. PATENT DOCUMENTS

| | | | | |
|---|---|---|---|---|
| 2006/0007114 | A1* | 1/2006 | Shiraishi | 345/103 |
| 2007/0103422 | A1 | 5/2007 | Wu | |
| 2008/0001895 | A1 | 1/2008 | Choi | |
| 2008/0036957 | A1 | 2/2008 | Hsu | |
| 2009/0009462 | A1 | 1/2009 | Hsu et al. | |
| 2009/0073154 | A1* | 3/2009 | Lee et al. | 345/211 |
| 2009/0225105 | A1 | 9/2009 | Park | |
| 2010/0277458 | A1* | 11/2010 | Liu et al. | 345/211 |
| 2011/0242412 | A1* | 10/2011 | Lee et al. | 348/500 |

FOREIGN PATENT DOCUMENTS

| | | |
|---|---|---|
| TW | 200809715 | 2/2008 |
| TW | 200903429 | 1/2009 |

* cited by examiner

INTEGRATED SOURCE DRIVING SYSTEM

BACKGROUND OF THE INVENTION

1. Technical Field

The present invention relates to a source driving system of a display device, and more particularly, to a source driving system with multiple source driving integrated circuits.

2. Description of the Prior Art

Please refer to FIG. 1. FIG. 1 is a diagram showing a display device 100 of the prior art. The display device 100 comprises a display panel 110, a plurality of source driver 120 arranged on the display panel 110, and a circuit board 130. The display panel 110 comprises a plurality of pixels P for displaying images. The source driver 120 is for driving the pixels P of the display panel 110. The circuit board 130 comprises a power driving unit 131, a memory 132, a data processor 133, a backlight driving unit 134, and a gamma voltage source 135. The power driving unit 131 is for generating a driving voltage to the source driver 120. The memory 132 is for storing predetermined data (such as setup values of the display panel 110) of the display panel 110. The data processor 133 is for accessing the predetermined data stored in the memory 132 and providing the setup values of the predetermined data of the display panel 110 to the source driver 120 for driving the pixels P of the display panel 110. The backlight driving unit 134 is for driving a backlight module of the display device 100. The gamma voltage source 135 is for generating a plurality of display voltages with different voltage levels, and the source driver 120 then drives the pixels P of the display panel 110 according to display data and the plurality of display voltages.

SUMMARY

An embodiment of the present invention provides a source driving system, which comprises a first source driving integrated circuit and a second source driving integrated circuit. The first driving integrated circuit comprises a first source driver for receiving first display data and driving pixels in a first block of a display panel according to the first display data. The second source driving integrated circuit comprises a second source driver electrically connected to the first source driver for receiving second display data and driving pixels in a second block of the display panel according to the second display data. The first source driver generates a first display parameter according to the first display data. The second source driver generates a second display parameter according to the second display data and transmits the second display parameter to the first source driver. The first source driver generates a third display parameter according to the first and second parameters and transmits the third display parameter to the second source driver.

Another embodiment of the present invention further provides a source driving system, which comprises a gamma voltage source, a first source driving integrated circuit, and a second source driving integrated circuit. The gamma voltage source is for generating a plurality of display voltages with different voltage levels. The first source driving integrated circuit is electrically connected to the gamma voltage source, for driving pixels of a first block of the display panel according to first display data and the plurality of display voltage. The second source driving integrated circuit is electrically connected to the gamma voltage source via the first source driving integrated circuit, for driving pixels of a second block of the display panel according to second display data and the plurality of display voltages.

Another embodiment of the present invention further provides a source driving system, which comprises a first source driving integrated circuit, and a second source driving integrated circuit. The first source driving integrated circuit comprises a first source driver for receiving first display data and driving pixels in a first block of the display panel according to the first display data, and a first power driver electrically connected to a voltage source and the first source driver for generating a first driving voltage to the first source driver. The second source driving integrated circuit comprises a second source driver for receiving second display data and driving pixels in a second block of the display panel according to the second display data, and a second power driver electrically connected to the voltage source, the first source driver and the second source driver for generating a second driving voltage to the second source driver. Wherein when a difference between the first driving voltage and the second driving voltage is greater than a predetermined value, the first power driver transmits a power driving signal to the second power driver, and the second power driver adjusts the second driving voltage according to the power driving signal.

These and other objectives of the present invention will no doubt become obvious to those of ordinary skill in the art after reading the following detailed description of the preferred embodiment that is illustrated in the various figures and drawings.

DETAILED DESCRIPTION

The following figures and illustration of the driving system and the display device with the driving system are disclosed according to the embodiments of the present invention, but the range of the present invention is not limited by the provided embodiments.

Figure 1:
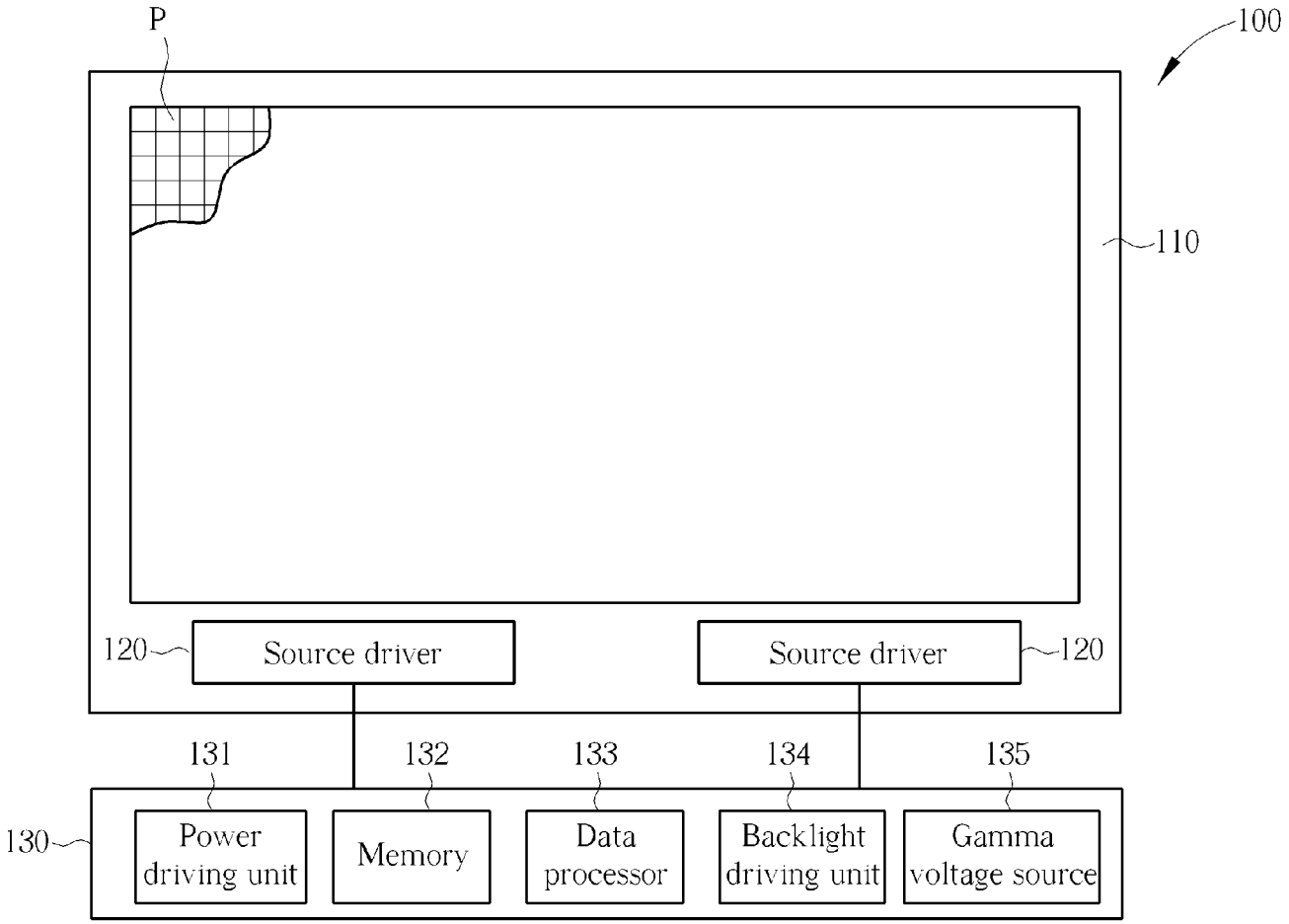
FIG. 1 PRIOR ART
FIG. 1 is a diagram showing a display device 100 of the prior art.
Figure 2:
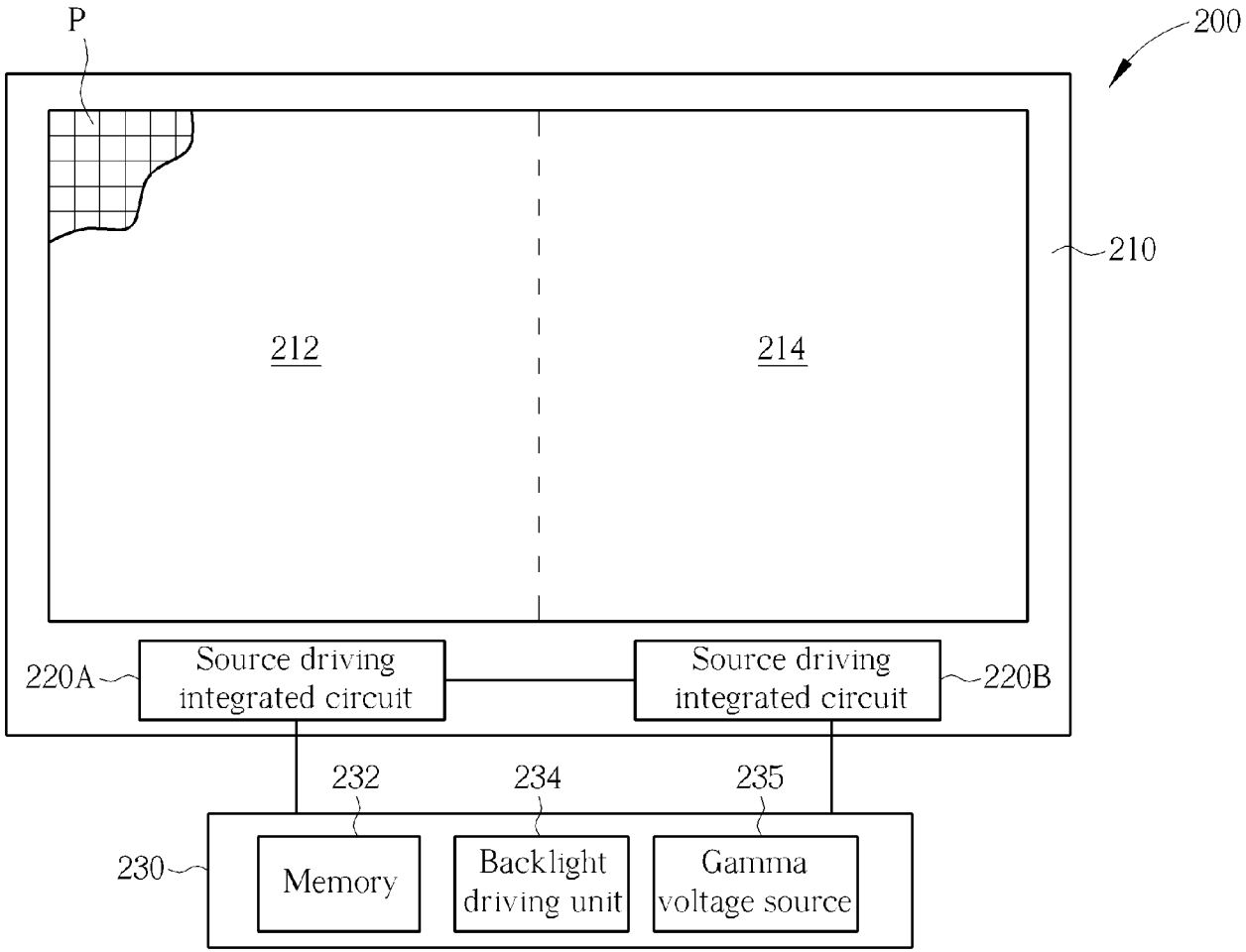
FIG. 2 is a diagram showing an embodiment of a display device of the present invention.
Figure 3:
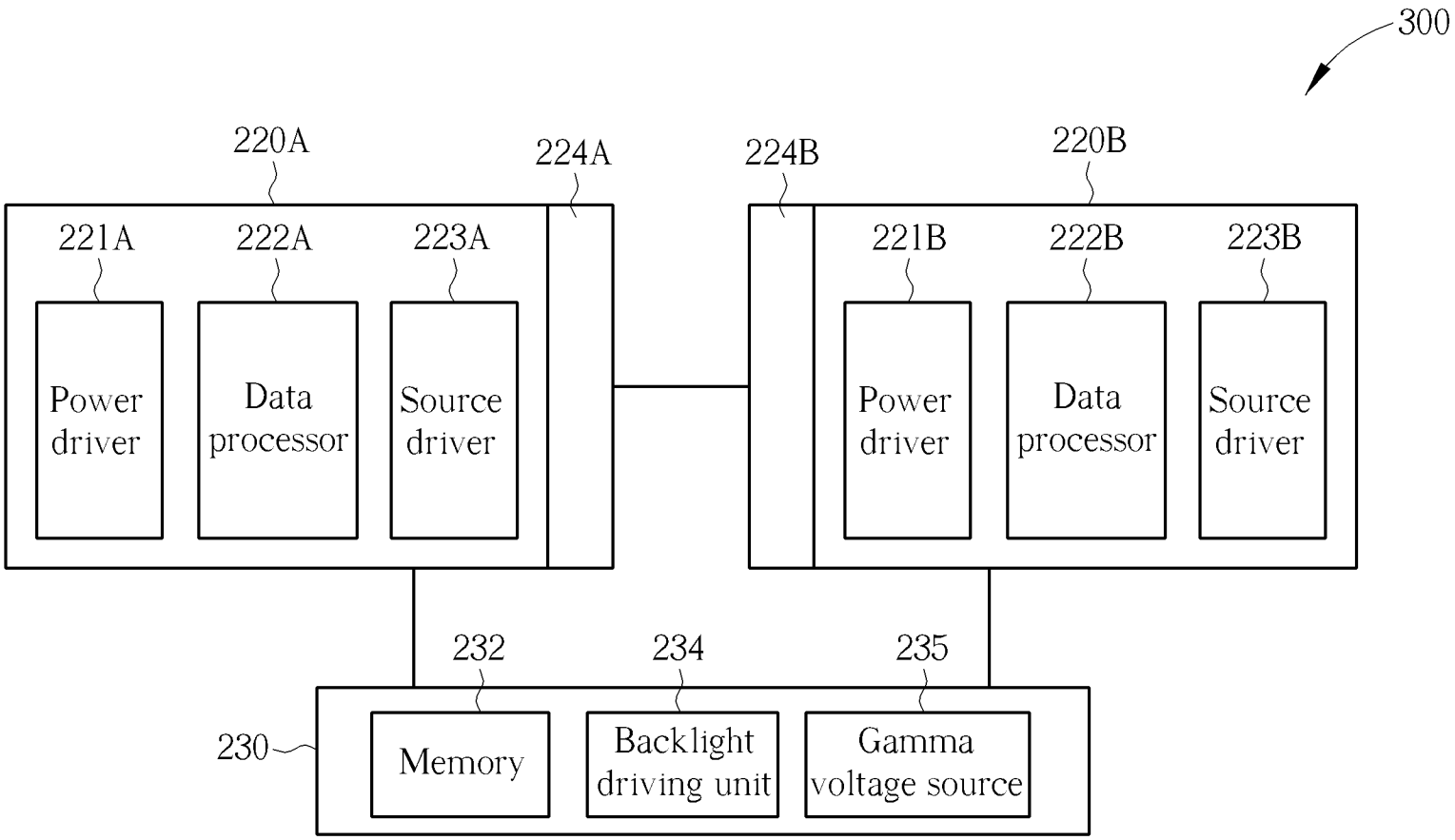
FIG. 3 is a diagram showing an embodiment of a source driving system of the present invention.

Please refer to FIG. 2 and FIG. 3. FIG. 2 is a diagram showing an embodiment of a display device 200 of the present invention. FIG. 3 is a diagram showing an embodiment of a source driving system 300 of the present invention. The display device 200 of the present invention comprises a display panel 210, a plurality of source driving integrated circuits 220A, 220B, and a circuit board 230, wherein the source driving integrated circuits 220A, 220B can be source driving chips or directly formed on the display panel (Source Driver on Array, SOA), and the source driving integrated circuits 220A, 220B are source driving chips in the present embodiment. The source driving integrated circuits 220A, 220B are electrically connected to the circuit board 230 respectively. As shown in FIG. 3, each of the source driving integrated circuits 220A, 220B comprises a power driver 221A, 221B, a data processor 222A, 222B, a source driver 223A, 223B, and respectively comprises a data transmission port 224A and 224B. Since the source driving integrated circuits 220A, 220B are integrated with the components originally arranged on the circuit board of the prior art, the circuit board 230 of the source driving system 300 of the present invention only needs to carry a memory 232 (such as a electrically erasable programmable read-only memory, EEPROM), a backlight driving unit 234, and a gamma voltage source 235, such that area of the circuit board 230 can be further reduced. In addition, in the present embodiment, the source driving integrated circuits 220A, 220B are applied to a liquid crystal display device, but the source driving integrated circuits 220A, 220B can also be utilized for driving a self-emitting display device, such as a field emission display device or an organic light emitting diode (OLED) display device. Therefore, the backlight driving unit 234 can be arranged according to different types of display devices.

Figure 4:
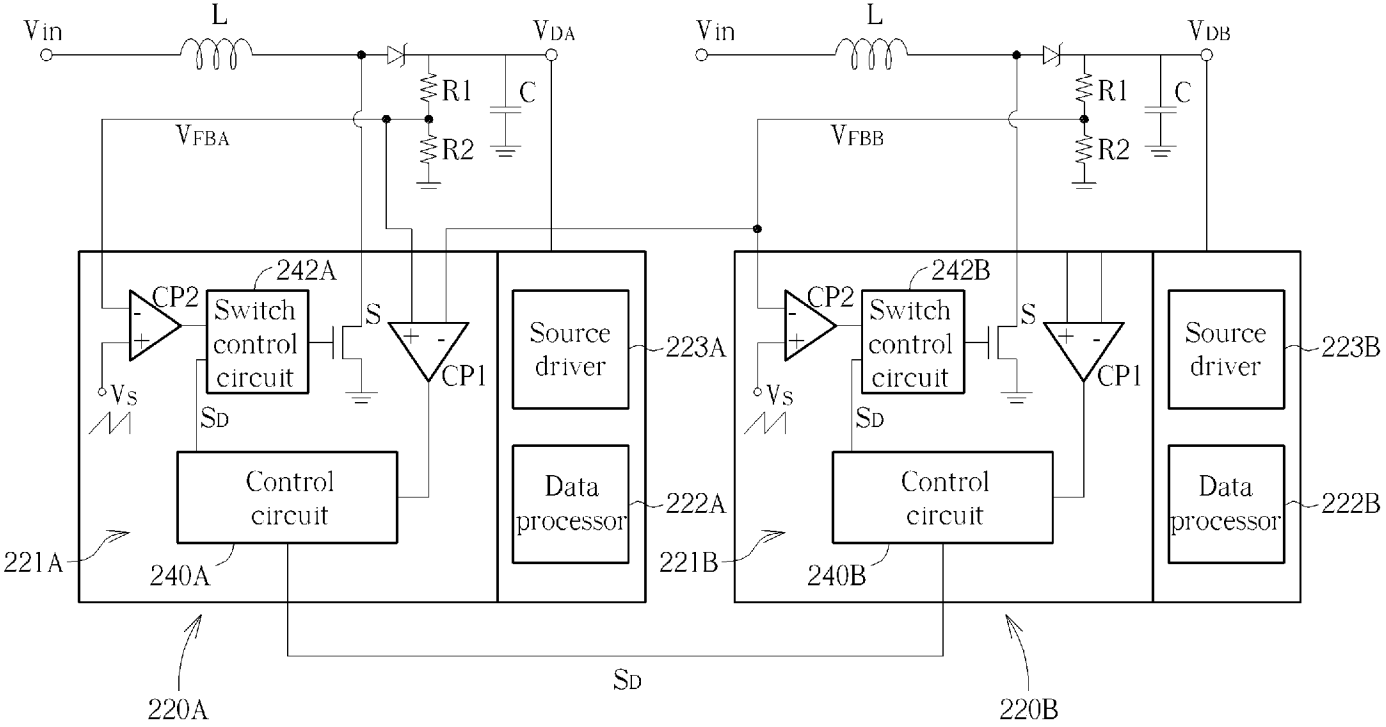
FIG. 4 is a diagram showing an embodiment of the source driving system of FIG. 3 generating driving voltages.

In addition, in order to operate synchronously and consistently between the source driving integrated circuits 220A, 220B, the source driving integrated circuits 220A, 220B may be able to communicate to each other. Please refer to FIG. 4. FIG. 4 is a diagram showing an embodiment of the source driving system 300 of FIG. 3 generating driving voltages. In the embodiment, the source driving integrated circuit 220A can be a master source driving integrated circuit, and the source driving integrated circuit 220B can be a slave source driving integrated circuit. The power drivers 221A, 221B of the source driving integrated circuits 220A, 220B respectively comprise comparators CP1, CP2, control circuits 240A, 240B, and switch control circuits 242A, 242B. In a general status, the power drivers 221A of the master source driving integrated circuit 220A and the power drivers 221B of the slave source driving integrated circuit 220B respectively generate driving voltages $V_{DA}$, $V_{DB}$ to the source drivers 223A, 223B and other components. For example, the comparator CP2 compares a feedback voltage $V_{FBA}$, $V_{FBB}$ of output ends with a sawtooth signal Vs for outputting a comparing signal. The switch control circuit 242A, 242B then controls an on-off ratio of the power switch S according to the comparing signal, so as to control the voltage level of the driving voltage $V_{DA}$, $V_{DB}$. However, there may be variances between resistors R1, R2, inductors L and capacitors C of source driving integrated circuit 220A and source driving integrated circuit 220B, and the variances cause the driving voltage $V_{DA}$ to be different from the driving voltage $V_{DB}$. In order to avoid or reduce the difference between the driving voltages $V_{DA}$, $V_{DB}$, the comparator CP1 of the master source driving integrated circuit 220A compares the feedback voltage $V_{FBA}$ of the master source driving integrated circuit 220A with the feedback voltage $V_{FBB}$ of the slave source driving integrated circuit 220B, when a difference between the feedback voltage $V_{FBA}$ of the master source driving integrated circuit 220A and the feedback voltage $V_{FBB}$ of the slave source driving integrated circuit 220B is greater than a predetermined value (which means the driving voltage $V_{DA}$ of the master source driving integrated circuit 220A and the driving voltage $V_{DB}$ of the slave source driving integrated circuit 220B is greater than a specific value), the source driving integrated circuits 220A, 220B are switched to a power synchronous status. In the power synchronous status, the control circuit 240A of the master source driving integrated circuit 220A generates a power driving signal $S_D$, and provides the power driving signal $S_D$ to the switch control circuit 242A of the master source driving integrated circuit 220A, and to the switch control circuit 242B of the slave source driving integrated circuit 220B via the control circuit 240B of the slave source driving integrated circuit 220B. The switch control circuits 242A, 242B of the source driving integrated circuits 220A, 220B then synchronously control on-off ratios of the power switches S according to the power driving signal $S_D$, so as to make the driving voltages $V_{DA}$, $V_{DB}$ generated by the source driving integrated circuits 220A, 220B consistent with each other.

In other words, an embodiment of the present invention discloses a method for driving the display device of FIG. 2. The method comprises: determining whether the difference between the feedback voltage $V_{FBA}$ of the master source driving integrated circuit 220A and the feedback voltage $V_{FBB}$ of the slave source driving integrated circuit 220B is greater than a predetermined value (that is determining whether the difference between the driving voltage $V_{DA}$ of the master source driving integrated circuit 220A and the driving voltage $V_{DB}$ of the slave source driving integrated circuit 220B is greater than the predetermined value); and when the difference between the feedback voltage $V_{FBA}$ of the master source driving integrated circuit 220A and the feedback voltage $V_{FBB}$ of the slave source driving integrated circuit 220B is greater than the predetermined value, the control circuit 240A of the master source driving integrated circuit 220A generating the power driving signal $S_D$, and providing the power driving signal $S_D$ to the switch control circuit 242A of the master source driving integrated circuit 220A, and to the switch control circuit 242B of the slave source driving integrated circuit 220B via the control circuit 240B of the slave source driving integrated circuit 220B.

Figure 5:
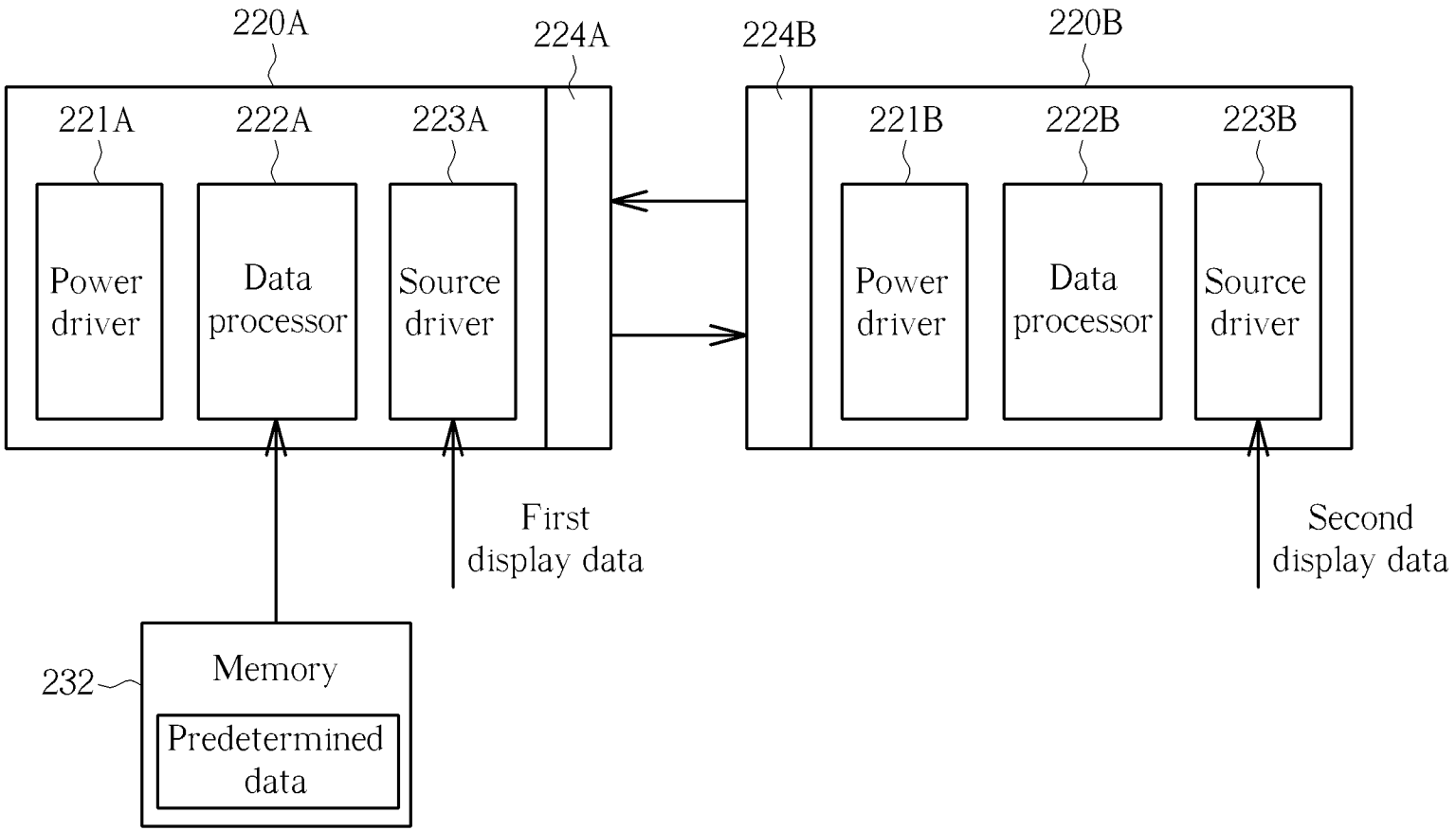
FIG. 5 is a diagram showing an embodiment of the source driving system of FIG. 3 driving the pixels of the display panel.

Please refer to FIG. 5, and refer to FIG. 2 as well. FIG. 5 is a diagram showing an embodiment of the source driving system of FIG. 3 driving pixels of the display panel. As shown in FIG. 5, the source driver 223A of the master source driving integrated circuit 220A is for receiving first display data, and driving the pixels P of a first block 212 of the display panel 210, and the source driver 223B of the slave source driving integrated circuit 220B is for receiving second display data, and driving the pixels P of a second block 214 of the display panel 210. In order to make display parameters (such as contrast and color gamut) of images on each blocks 212, 214 of the display panel 210 corresponding to each other, the source driver 223A of the master source driving integrated circuit 220A generates a first display parameter according to the first display data, and the source driver 223B of the slave source driving integrated circuit 220B generates a second display parameter according to the second display data and transmits the second display parameter to the source driver 223A of the master source driving integrated circuit 220A. The source driver 223A of the master source driving integrated circuit 220A further generates a third display parameter according to the first display parameter and the second display parameter, and transmits the third display parameter to the source driver 223B of the slave source driving integrated circuit 220B. Therefore, the display parameters of images on each block 212, 214 can correspond to each other. The master source driving integrated circuit 220A and the slave source driving integrated circuit 220B transmit data and parameters via the data transmission ports 224A, 224B.

In other words, an embodiment of the present invention discloses a method for driving the display device of FIG. 2. The method comprises: the source driver 223A of the master source driving integrated circuit 220A receiving the first display data and generating the first display parameter according to the first display data; the source driver 223B of the slave source driving integrated circuit 220B receiving the second display data and generating the second display parameter according to the second display data; transmitting the second display parameter to the source driver 223A of the master source driving integrated circuit 220A; the source driver 223A of the master source driving integrated circuit 220A generating the third display parameter according to the first display parameter and the second display parameter; transmitting the third display parameter to the source driver 223B of the slave source driving integrated circuit 220B; and driving the display panel 210 according to the first display parameter, the second display parameter and the third display parameter. Moreover, the master source driving integrated circuit 220A may modify the first display data to generate a modified first display data according to the second display parameter and/or the third display parameter, and the slave source driving integrated circuit 220B may modify the second display data to generate a modified second display data according to the first display parameter and/or the third display parameter. After that, the master source driving integrated circuit 220A can drive the corresponding pixels according to the modified first display data, and the slave source driving integrated circuit 220B can drive the corresponding pixels according to the modified second display data.

In addition, in order to make setup values (such as setup values of contrast and color gamut) of each block 212, 214 of the display panel 210 consistent with each other, the data processor 222A of the master source driving integrated circuit 220A is electrically connected to the memory 232 for accessing the setup values of the display panel in the predetermined data stored in the memory 232, and the data processor 222B of the slave source driving integrated circuit 220B receives the predetermined data transmitted from the data processor 222A of the master source driving integrated circuit 220A via the data transmission ports 224A, 224B, such that the setup values of each block 212, 214 of the display panel 210 are consistent with each other.

Figure 6:
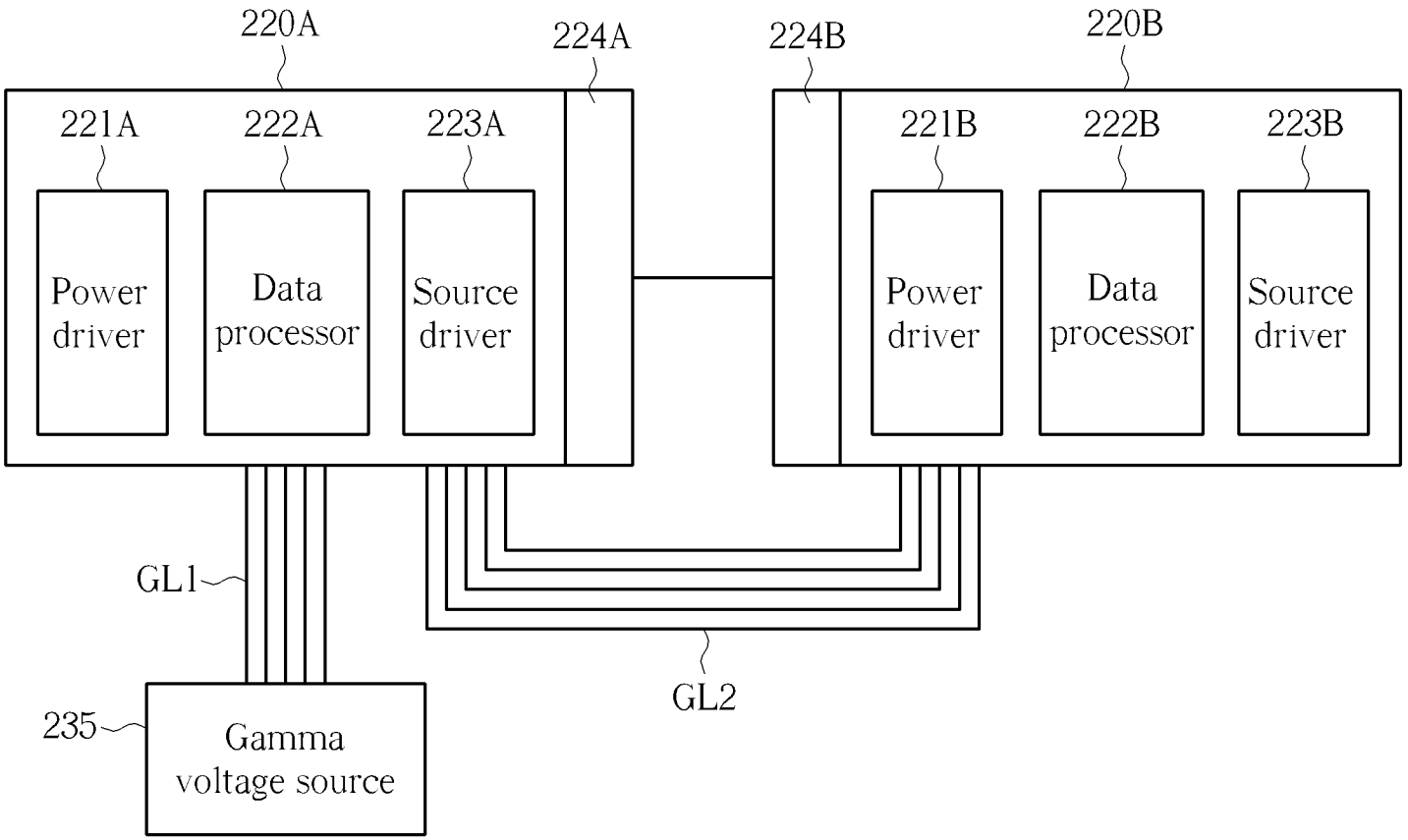
FIG. 6 is a diagram showing an embodiment of the source driving system of FIG. 3 providing display voltages to the source drivers.

Please refer to FIG. 6. FIG. 6 is a diagram showing an embodiment of the source driving system of FIG. 3 providing display voltages to the source drivers. The gamma voltage source 235 on the circuit board 230 is for generating a plurality of display voltages with different voltage levels. The master source driving integrated circuit 220A is electrically connected to the gamma voltage source 235 via gamma lines GL1, and the slave source driving integrated circuit 220B is electrically connected to the gamma voltage source 235 via gamma lines GL1, GL2 and the master source driving integrated circuit 220A. The source drivers 223A, 223B drive liquid crystals of the pixels P of the display panel 210 to rotate according to the display voltages generated by the gamma voltage source 235. According to the above arrangement, the slave source driving integrated circuit 220B is electrically connected to the gamma voltage source 235 via the master source driving integrated circuit 220A, such that the area of the circuit board 230 can be further reduced. Furthermore, the gamma lines GL1, GL2 can be arranged on an array area of the display panel (Wire on Array).

Those skilled in the art should know that in a larger display device, there could be more source driving integrated circuits utilized for driving each block of the display panel. Although the embodiment of the present invention only utilizes two source driving integrated circuits, but the number of the source driving integrated circuits is not limited by the provided embodiments. Each of the source driving integrated circuits generates the display parameter according to the received display data, and the display parameter can be transmitted in an order. For example, the display parameter of a third source driving integrated circuit is transmitted to a second source driving integrated circuit, and the second source driving integrated circuit further transmits the display parameter of the third source driving integrated circuit to a first source driving integrated circuit, or, the third source driving integrated circuit can be electrically connected to the first source driving integrated circuit for directly transmitting the display parameter to the first source driving integrated circuit. In addition, when the display device comprise more than two source driving integrated circuits, the data stored in the memory can be transmitted to the source driving integrated circuits in a specific order, or, the data stored in the memory can be read by a specific source driving integrated circuit, and then directly transmitted to each of the source driving integrated circuits. Similarly, the display voltages of the gamma voltage source can be transmitted to each of the source driving integrated circuits in the similar way.

Moreover, when the display device comprises more than two source driving integrated circuits, one of the source driving integrated circuits can be the master source driving integrated circuit, and other source driving integrated circuits can be the slave source driving integrated circuits. The display device can control power output of the slave source driving integrated circuits via the master source driving integrated circuit.

According to the above arrangement, data and signals between the master source driving integrated circuit and the slave source driving integrated circuit can be synchronized, such that operations between the master source driving integrated circuit and the slave source driving integrated circuit can correspond to each other.

The present invention provides the integrated source driving system for reducing the area of the circuit board, and further saving the internal space of the display device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A source driving system for driving a display panel, the source driving system comprising: a first source driving integrated circuit, comprising: a first source driver for receiving first display data, driving pixels in a first block of the display panel according to the first display data and generating a first display parameter according to the first display data; and a first power driver electrically connected to a voltage source and the first source driver for generating a first driving voltage to the first source driver; and a second source driving integrated circuit, comprising: a second source driver electrically connected to the first source driver for receiving second display data, driving pixels in a second block of the display panel according to the second display data, generating a second display parameter according to the second display data, and transmitting the second display parameter to the first source driver; and a second power driver electrically connected to the voltage source, the first source driver and the second source driver for generating a second driving voltage to the second source driver wherein the first source driver is further configured to generate a third display parameter according to the first and second parameters and to transmit the third display parameter to the second source driver; wherein when a difference between the first driving voltage and the second driving voltage is greater than a predetermined value, the first power driver transmits a power driving signal to the second power driver, and the second power driver adjusts the second driving voltage according to the power driving signal.

2. The source driving system of claim 1 further comprising a memory for storing predetermined data;

wherein the first source driving integrated circuit further comprises a first data processor for accessing the predetermined data, and the first source driving integrated circuit is further configured to transmit the predetermined data to the second source driving integrated circuit, and the second source driving integrated circuit further comprises a second data processor for receiving the predetermined data stored in the memory from the first source driving integrated circuit.

3. The source driving system of claim 2, wherein the first source driving integrated circuit further comprises a first data transmission port electrically connected to the first data processor, the second source driving integrated circuit further comprises a second data transmission port electrically connected to the first data transmission port and the second data processor, and the first data processor and the second data processor are configured to transmit data via the first data transmission port and the second data transmission port.

4. The source driving system of claim 3 further comprising a gamma voltage source for generating a plurality of display voltages with different voltage levels, wherein the first source driving integrated circuit is electrically connected to the gamma voltage source, the second source driving integrated circuit is electrically connected to the gamma voltage source via the first source driving integrated circuit, the first source driving integrated circuit is configured to drive the pixels in the first block of the display panel according to the first display data and the plurality of display voltages, and the second source driving integrated circuit is configured to drive the pixels in the second block of the display panel according to the second display data and the plurality of display voltages.

5. The source driving system of claim 1, wherein the first source driving integrated circuit further comprises a first data transmission port electrically connected to the first data processor, the second source driving integrated circuit further comprises a second data transmission port electrically connected to the first data transmission port and the second data processor, and the first data processor and the second data processor are configured to transmit data via the first data transmission port and the second data transmission port.

6. The source driving system of claim 5 further comprising a gamma voltage source for generating a plurality of display voltages with different voltage levels, wherein the first source driving integrated circuit is electrically connected to the gamma voltage source, the second source driving integrated circuit is electrically connected to the gamma voltage source via the first source driving integrated circuit, the first source driving integrated circuit is configured to drive the pixels in the first block of the display panel according to the first display data and the plurality of display voltages, and the second source driving integrated circuit is configured to drive the pixels in the second block of the display panel according to the second display data and the plurality of display voltages.

7. The source driving system of claim 1 further comprising a gamma voltage source for generating a plurality of display voltages with different voltage levels, wherein the first source driving integrated circuit is electrically connected to the gamma voltage source, the second source driving integrated circuit is electrically connected to the gamma voltage source via the first source driving integrated circuit, the first source driving integrated circuit is configured to drive the pixels in the first block of the display panel according to the first display data and the plurality of display voltages, and the second source driving integrated circuit is configured to drive the pixels in the second block of the display panel according to the second display data and the plurality of display voltages.

8. A source driving system for driving a display panel, the source driving system comprising: a gamma voltage source for generating a plurality of display voltages with different voltage levels; a first source driving integrated circuit electrically connected to the gamma voltage source, for driving pixels of a first block of the display panel according to first display data and the plurality of display voltages; a first power driver electrically connected to a voltage source and the first source driver for generating a first driving voltage to the first source driver; a second source driving integrated circuit electrically connected to the gamma voltage source via the first source driving integrated circuit, for driving pixels of a second block of the display panel according to second display data and the plurality of display voltages; and a second power driver electrically connected to the voltage source, the first source driver and the second source driver for generating a second driving voltage to the second source driver; wherein when a difference between the first driving voltage and the second driving voltage is greater than a predetermined value, the first power driver transmits a power driving signal to the second power driver, and the second power driver adjusts the second driving voltage according to the power driving signal.

9. A source driving system for driving a display panel, the source driving system comprising:

a first source driving integrated circuit, comprising:

a first source driver for receiving first display data and driving pixels in a first block of the display panel according to the first display data; and a first power driver electrically connected to a voltage source and the first source driver for generating a first driving voltage to the first source driver; and a second source driving integrated circuit, comprising:

a second source driver for receiving second display data and driving pixels in a second block of the display panel according to the second display data; and a second power driver electrically connected to the voltage source, the first source driver and the second source driver for generating a second driving voltage to the second source driver;

wherein when a difference between the first driving voltage and the second driving voltage is greater than a predetermined value, the first power driver transmits a power driving signal to the second power driver, and the second power driver adjusts the second driving voltage according to the power driving signal.

10. The source driving system of claim 9, wherein the first source driving integrated circuit further comprises:

a comparator electrically configured to receive the first driving voltage and the second driving voltage for comparing the first driving voltage and the second driving voltage to output a comparing signal; and a control circuit for controlling the first power driver to transmit the power driving signal to the second power driver according to the comparing signal when the difference between the first driving voltage and the second driving voltage is greater than the predetermined value.

11. The source driving system of claim 10 further comprising a memory for storing predetermined data; wherein the first source driving integrated circuit further comprises a first data processor for accessing the predetermined data and transmitting the predetermined data to the second source driving integrated circuit, and the second source driving integrated circuit further comprises a second data processor for receiving the predetermined data stored in the memory from the first source driving integrated circuit.

12. The source driving system of claim 11, wherein the first source driving integrated circuit further comprises a first data transmission port, the second source driving integrated circuit further comprises a second data transmission port electrically connected to the first data transmission port, and the first data processor and the second data processor are configured to transmit data via the first data transmission port and the second data transmission port.

13. The source driving system of claim 12 further comprising a gamma voltage source for generating a plurality of display voltages with different voltage levels, wherein the first source driving integrated circuit is electrically connected to the gamma voltage source, the second source driving integrated circuit is electrically connected to the gamma voltage source via the first source driving integrated circuit, the first source driving integrated circuit is configured to drive the pixels in the first block of the display panel according to the first display data and the plurality of display voltages, and the second source driving integrated circuit is configured to drive the pixels in the second block of the display panel according to the second display data and the plurality of display voltages.

* * * * *